US005113681A

United States Patent [19]

Guesnon et al.

[11] Patent Number: 5,113,681

[45] Date of Patent: May 19, 1992

[54] METHOD AND APPARATUS FOR FORMING A TITANIUM OR TITANIUM ALLOY SHEET ELEMENT WITH A CONTOURED SURFACE

[75] Inventors: Jean Guesnon, Chatou; Andre Laurencin, Lyons; Claude Klopfeinstein, Giromagny, all of France

[73] Assignee: Institut Francais du Petrole, Rueil Malmaison, France

[21] Appl. No.: 415,974

[22] Filed: Jul. 31, 1989

Related U.S. Application Data

[63] Continuation of PCT/FR88/00479, Sep. 29, 1988.

[30] Foreign Application Priority Data

Sep. 29, 1988 [FR] France ..... 87 13467

[51] Int. Cl.[5] ..... B21B 45/02; B21D 37/16

[52] U.S. Cl. ..... 72/53; 72/342.5; 72/364; 72/379.2; 72/700; 72/709

[58] Field of Search ..... 72/342.1, 342.5, 364, 72/379.2, 700, 709, 53

[56] References Cited

U.S. PATENT DOCUMENTS

| | | | |
|---|---|---|---|
| 3,974,673 | 8/1976 | Fosness | 72/700 |
| 4,474,044 | 10/1984 | Leistner et al. | 72/364 |
| 4,658,362 | 4/1987 | Bhatt | 72/364 |

FOREIGN PATENT DOCUMENTS

| | | | |
|---|---|---|---|
| 2004410 | 11/1969 | France | 72/709 |

OTHER PUBLICATIONS

IBM Journal, Mar. 1965, "Sheet Thermoforming of a Superplastic Alloy", vol. 9, No. 2, p. 134.

*Primary Examiner*—David Jones

*Attorney, Agent, or Firm*—Antonelli, Terry Stout & Kraus

[57] ABSTRACT

A process and apparatus for forming a sheet element with a contoured surface from a plane titanium or titanium alloy sheet by hot deep-drawing in a press. The plane sheet is preheated to a temperature of at least 730° C. and transferred to a non-preheated deep drawing tool. The deep-drawing tool is placed in a press for a period of time sufficient for the temperature of the element to be at least 700° C. at the end of the deep-drawing operation. The deep drawn element is transferred to a calibration tool and heated to at least 650° C. for a sufficient time to assume a final shape and allowed to cool to room temperature.

17 Claims, 2 Drawing Sheets

METHOD AND APPARATUS FOR FORMING A TITANIUM OR TITANIUM ALLOY SHEET ELEMENT WITH A CONTOURED SURFACE

This is a continuation of international PCT application Ser. No. PCT/FR88/00479, filed Sep. 29, 1988.

BACKGROUND OF THE INVENTION

The present invention relates to a process and apparatus for forming a sheet element with a contoured surface from a plane titanium or titanium alloy sheet by hot deep drawing in a press.

In certain cases, it is necessary to fabricate contoured-surface shapes, particularly cylindrical or frustroconical, for example, for fabricating tubes whose thickness may reach or exceed 10 mm, from titanium or titanium alloy, particularly the alloy containing 6 wt. % aluminum and 4 wt. % vanadium, generally known as TA 6V, which has good properties in terms of lightness (density 4.5), mechanical strength (tensile strength at least 900 MPa) and corrosion resistance, particularly to seawater. Such tubes or tube elements would be particularly suitable for connecting a drilling platform and drilling head to the deep sea bed, since steel tubes or tube elements would be too heavy. The alloy containing 3 wt. % aluminum and 2 wt. % vanadium, known as TA 3V, could also be suitable for such applications.

Forming such tubes from plane sheets first means forming the plane sheet into a contoured surface element, particularly cylindrical or conical with a center angle (angle formed by the planes passing through the axis and the extreme generatrices) of, for example, 180° or 120°, followed by welding the elements obtained along generatrices to form the tube or a closed shell. The prior art confirmed by testing indicates that such forming cannot be done by a cold process since the mechanical properties of the sheet do not lend themselves to this deformation without becoming unusable. In particular, it is impossible to control precisely the dimensional characteristics of the fabricated part. However, hot forming is a relatively complex operation generally carried out by positioning the sheet in a tool which is itself preheated above the minimum temperature at which forming is to take place. The tool must be heated to the desired temperature before each forming operation, which necessitates a relatively slow rate of fabrication.

The purpose of the present invention is to provide a process for fabricating contoured-surface sheet elements, particularly cylindrical or conical, that is simpler and faster and which nonetheless produces elements of regular thickness and precise dimensions with no cracks. The forming process according to the invention is characterized by the plane sheet element being preheated to a temperature of at least 730° C., by the preheated element being transferred to a non-preheated deep-drawing tool placed in the press soon enough for the temperature of the element to be still at least 700° C. at the time of the deep-drawing operation, by transferring the deep-drawn element to a calibration tool and heating the deep drawn element to at least 650° C. for a sufficient time for its definitive shaping, then allowing the so-processed element to cool to room temperature. The process of the present invention is particularly suitable for forming a sheet element 25 mm thick or less, and the deep-drawn element is preferably kept at a temperature of at least 650° C. in the calibration tool for at least one hour.

For forming such a sheet element, according to the present invention, the temperature of the deep-drawn sheet element is brought to about 650° C. in at least 5 hours and held at about 650° C. for approximately one hour, allowed to cool in the calibration tool for at least 10 hours, and then is removed from this tool and allowed to air-cool.

The formed sheet element may, according to the present invention, be descaled by shot-blasting and, for this purpose, steel balls with diameters between 0.6 millimeters and 0.16 millimeters are used for shot-blasting.

After shot-blasting, according to the invention, the element is finished by being pickled in a cold bath of an aqueous solution with 15 to 40 wt. % nitric acid and 1 to 2 wt. % hydrofluoric acid, with the nitric acid/hydrofluoric acid weight ratio being higher than 10 and the solution containing less than 10 g/l of the total (iron+titanium) for 1 to 5 minutes followed by rinsing and drying.

If, after forming, blasting, and the finishing stage of chemical pickling, the element is left in storage for a relatively long period of time, a patina forms which negatively affects its appearance but not its properties. It can then be chemically pickled in a cold bath similarly to the finishing stage of chemical pickling.

The present invention also relates to apparatus for forming a contoured-surface sheet element from a plane sheet, with the apparatus included a combination of means for heating said plane sheet, a conveyor, a press, and calibration means, these various elements being distinct from each other.

The press may, in accordance with the present invention, be fitted with at least one insert, and, may have a furnace designed to receive the calibration means. Additionally, the mechanical descaling means may be provided for carrying out a descaling operation.

An apparatus for forming cylindrical sheet elements and a method for forming and descaling according to the invention is described hereinbelow as an example with reference to the accompanying drawings.

BRIEF DESCRIPTION OF THE DRAWINGS

In FIG. 1, halves 1 and 2 are shown in the position in which they would face each other with a view to welding along their longitudinal edges 4, 5, 6, 7 to form a tube element. The halves 1, 2 have substantial thickness which may exceed 12.7 mm, as can be seen from their semicircular ends 7, 8.

As shown in FIG. 2, a furnace generally designated by the reference numeral 11, for example an electric or gas furnace, preheats the plane sheet element, and, after heating to the desired temperature, a furnace door 12 is raised by means of counter-weight levers 13, 14. The preheated elements are placed on motorized conveyor generally designated by the reference numeral 15 which has rotating cylindrical elements 16, and conveyed to press generally designated by the reference numeral 17.

Figures 1, 2, 4:
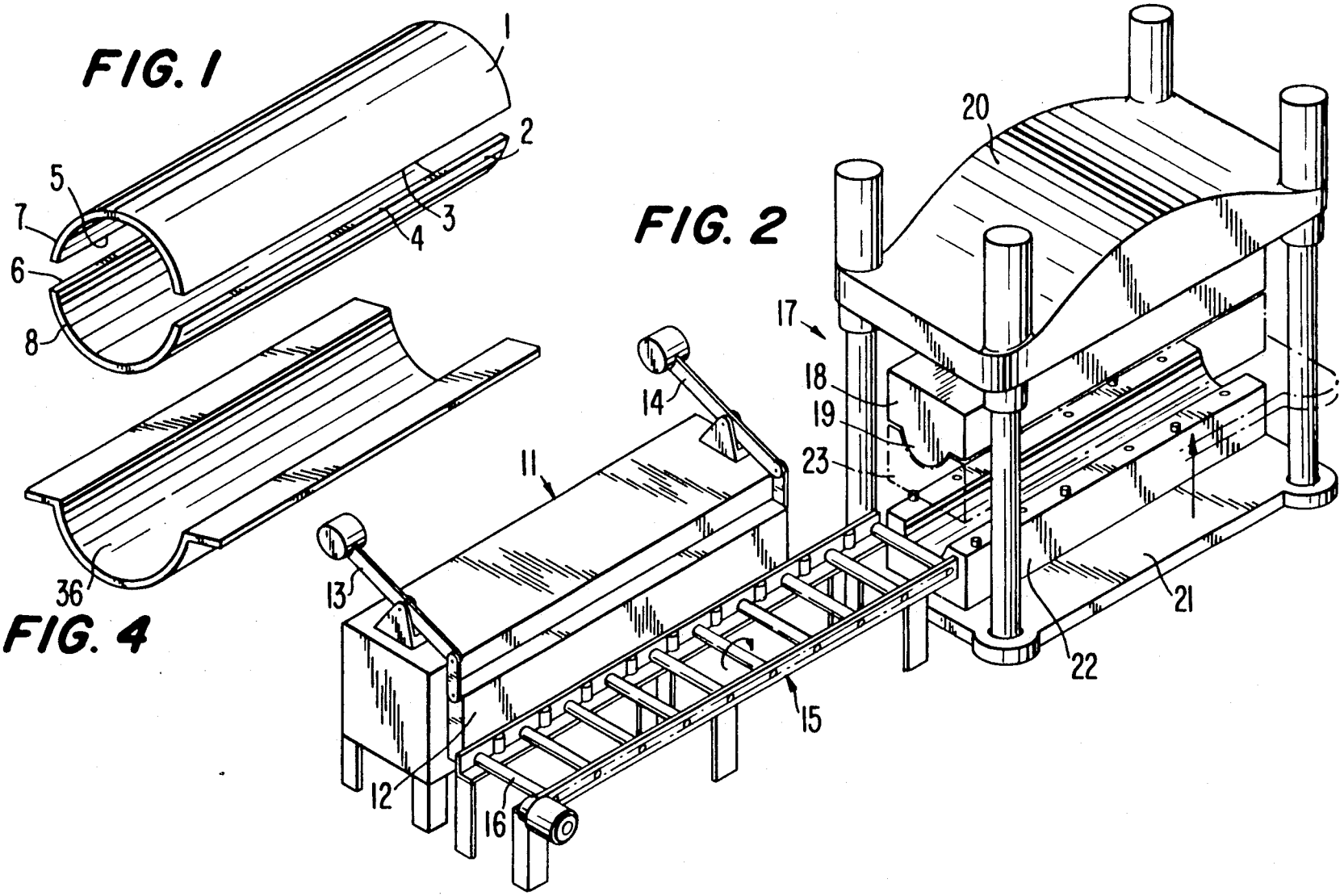
FIG. 1 is a perspective view of two deep-drawn, calibrated cylindrical sheet elements.
FIG. 2 is a schematic perspective view of a furnace for heating sheet elements and a press for deep-drawing the heated elements into cylindrical halves.
FIG. 4 is a perspective view of an insert.

The press 17 has a fixed elongated punch 18 with an active part 19 integral with upper frame 20 and with a substantially semicircular straight section between two lateral shoulders. Below this punch 18 is a mobile die whose lower loading position (resting on base 21) is shown at 22 and whose upper deep-drawing position at 23 (dashed lines). It is obvious that it will not be a departure from the present invention for the punch 18 to be mobile and the die to be fixed. The punch 18 and/or mobile die may be fitted with inserts of variable thickness between which the plane sheet element is introduced. This insert or inserts allow(s) shells of different dimensions to be obtained from a given punch/die pair. Thus, these inserts are tools which adapt to the punch and/or the die to allow the geometric characteristics of the fabricated shell to be modified. It is obvious that the modifications that may be obtained are limited by the dimensions of the punch 18 and die in the absence of an insert.

FIG. 4 represents an insert 36 usable on die 22 and which, if it were used, would permit reduction of the external dimensions of the fabricated halves 1, 2.

After deep-drawing, the formed halves 1, 2 do not, however, have a fully semi-cylindrical shape as their radii of curvature are greater than the desired value. They must hence be subjected to calibration treatment at a temperature of at least 650° C.

Figure 3:
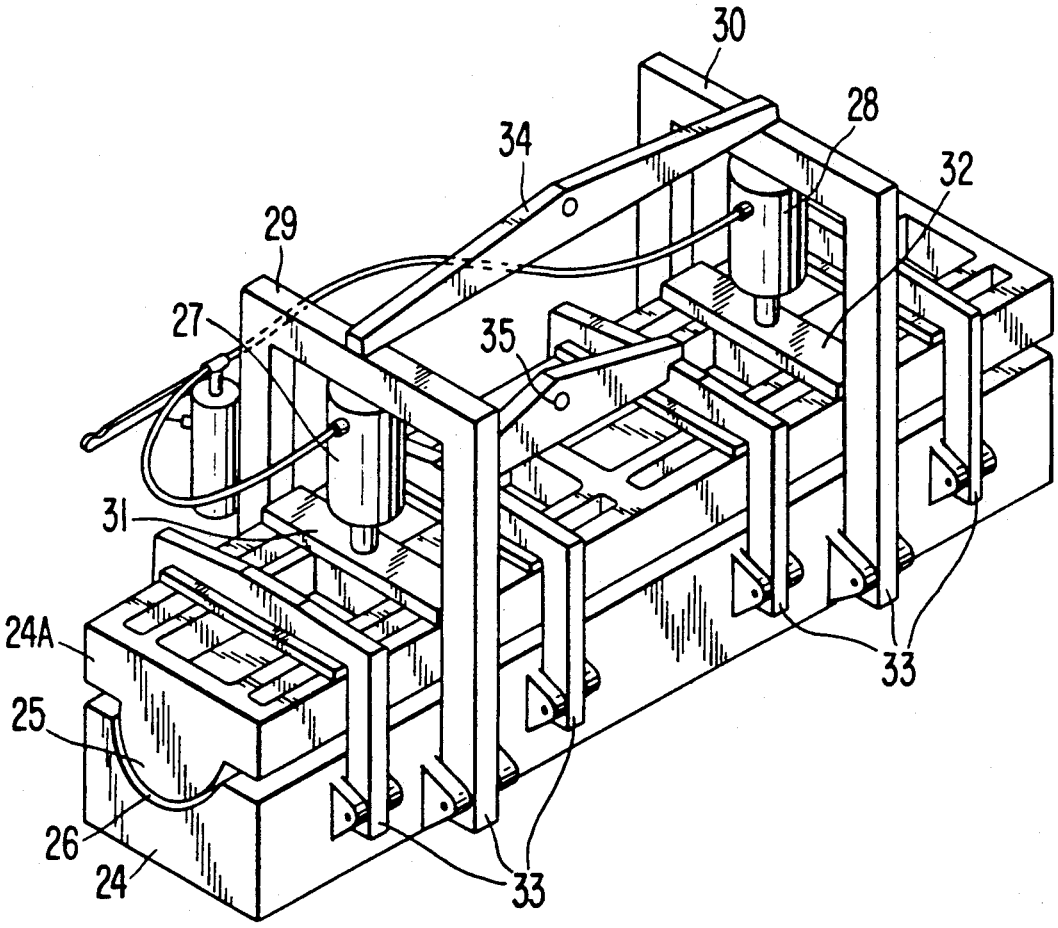
FIG. 3 is a perspective view of a tool for hot calibration of the cylindrical halves.

The halves 1, 2 to be calibrated, held in the press inserts, are introduced with the latter into the calibration apparatus shown in FIG. 3. The calibration apparatus comprises a base 24 and a punch 24A having a semi-cylindrical central part 25 and lateral shoulders. Half 26 is held tightly between base 24 and punch 24A by jacks 27, 28 supported by arches 29, 30 and resting on plane beams 31, 32. Flanges 33 maintain the compression of the tool. A handle 34 allows the arches 29, 30 to be raised and another handle 35 allows the tool assembly to be raised. This tool assembly and the halves 1, 2 are heated by placing them in a hot furnace with the temperature rise time being 5 hours, followed by a constant temperature of 650° C. for at least one hour and cooling taking 10 hours in the furnace. The part and the inserts are removed from the furnace at approximately 200° to 300° C., then air-cooled. The part then has its final semi-cylindrical shape and it is removed from its inserts.

After calibration, the halves 1, 2 must be treated to remove the oxide scale. It has been shown that chemical descaling by immersion in a bath of nitric and hydrofluoric acids, even when hot, is ineffective and that immersion in an aqueous alkaline solution eliminates only the thin oxide scale. Immersion in a concentrated soda or concentrated soda and nitrate bath is more effective but poses safety problems and must be followed by neutralization in an acid bath. The preferred descaling method according to the invention is blasting with steel shot 0.06 to 0.16 mm in diameter until the oxide scale disappears. This mechanical descaling may be followed by final descaling by immersion in an aqueous solution of 15 to 40 wt. % (preferably 20 wt. %) nitric acid and 1 to 2 wt. % hydrofluoric acid, with the weight ratio between nitric acid and hydrofluoric acid being higher than 10 to limit the risk of hydrogen being absorbed by the alloy.

The solution must also contain less than 120 g/l of the total (iron + titanium) and must in any event be renewed as soon as the titanium content exceeds 10 g/l.

The length of immersion may range between 1 and 5 minutes, with 2 minutes generally being sufficient. After removal of the half from the final descaling bath, it is rinsed with water and dried.

If elements are to be made from contoured-surface sheet with a different shape, semi-frustroconical, for example, presses and calibration tools adapted to the desired shape will be used.

We claim:

1. A method of forming a sheet element with a contoured surface from a plane titanium or titanium alloy sheet element by a hot deep-drawing operation in a press, the method comprising the steps of preheating the sheet element to a temperature of at least 730° C., transferring the preheated sheet element to non-preheated deep-drawing tool means, placed in the press for a period of time sufficient for the temperature of the sheet element to be at least equal to 700° C. at the end of the deep-drawing operation thereby forming a deep-drawn element, transferring the deep-drawn element to a calibration tool means and heating the deep-drawn element in the calibration means to at least 650° C. for a sufficient time to assume a final shape, then allowing the deep-drawn element to cool to room temperature.

2. Method according to claim 1, wherein the sheet element has a thickness of 25 mm or less, the method further comprising the step of holding the heated deep-drawn element at a temperature of at least 650° C. in the calibration tool means for at least one hour.

3. Method according to claim 1, further comprising the step of raising the temperature of the deep-drawn element to approximately 650° over at least five hours, holding the deep-drawn element at approximately 650° C. for at least one hour, allowing the deep-drawn element to cool in the calibration tool for at least 10 hours, then extracting the deep-drawn element from the calibration tool and allowing the deep-drawn element to air-cool.

4. Method according to one of claims 1, 2 or 3, further comprising the step of subjecting the shaped sheet element to descaling by shot-blasting with hard metal balls.

5. Method according to claim 4, wherein the steel balls has a diameter between 0.6 mm and 0.16 mm.

6. Method according to claim 5, further comprising, after shot-blasting, a descaling process in a cold bath of an aqueous solution with 15 ° to 50° wt. % nitric acid and 122 wt. % hydrofluoric acid, with a weight ratio between the nitric acid and hydrofluoric acid being over 10 and the aqueous solution containing less than 10 g/l of the total iron and titanium for 1 to 5 minutes, followed by rinsing and drying.

7. Apparatus for forming a sheet element with a contoured surface from a plane sheet, the apparatus comprising heating means for heating said sheet element, a press means for shaping the sheet element, a conveyor means for conveying the sheet element from the heating means to the press means, and calibration means disposed downstream of said press means for shaping the sheet element into a desired form, and wherein the heating means, conveyor means and calibration means are separate and independent units.

8. Apparatus according to claim 7, wherein at least one insert is fitted in said press means.

9. Apparatus according to one of claims 7 or 8, further comprising mechanical descaling means disposed downstream of said calibration means for descaling the formed sheet element.

10. Apparatus for forming a sheet element with a contoured surface from a plane sheet, the apparatus comprising heating means for heating said sheet element, a press means for shaping the sheet element, a conveyor means for conveying the sheet element from the heating means to the press means, and calibration means disposed downstream of said press means for shaping the sheet element in a desired form, wherein the heating means, conveyor means and calibration means are separate and independent units, said heating means includes a furnace means for receiving said calibration means.

11. Apparatus for forming a sheet element with a contoured surface from a plane titanium or titanium alloy sheet element, the apparatus comprising press means for carrying out a hot deep-drawing operation of the sheet element, means for preheating the sheet element to a temperature of at least 730° C., means for transferring the sheet element from the means for preheating to non-preheated deep-drawing tool means placed in said press means for a period of time sufficient for the temperature of the sheet element to be at least equal to 700° at the end of the hot deep-drawing operation, means for transferring the deep-drawn element from the press means to a calibration tool means, and means for heating the deep-drawn element in the calibration tool means to at least 650° for a sufficient time to assume a final shape.

12. An apparatus according to claim 11, wherein said means for heating, means for transferring, and said calibration tool means are separate and independent units.

13. Apparatus according to one of claims 11 or 12, further comprising first means disposed downstream of said calibration means for de-scaling the final shaped sheet element.

14. Apparatus according to claim 13, wherein said means for descaling includes a means for shot-blasting the shaped sheet element with hard metal balls.

15. Apparatus according to claim 14, comprising a further descaling means disposed downstream of said first means for descaling the shaped sheet element subsequent to processing by the means for shot-blasting.

16. Apparatus according to claim 15, wherein said further means for descaling includes a cold bath of an aqueous solution with 15 to 50 wt. % nitric acid and 122 wt. % hydrofluoric acid, with a weight ratio between the nitric acid and the hydrofluoric acid being over 10 and the aqueous solution containing less than 10 g/l of the total iron and titanium.

17. Apparatus according to claim 16, further comprising a means disposed downstream of said further means for de-scaling for rinsing and drying the shaped sheet element subsequent to processing by said further means for descaling.

* * * * *